US009152157B2

(12) United States Patent
Hu et al.

(10) Patent No.: US 9,152,157 B2
(45) Date of Patent: Oct. 6, 2015

(54) FAST RESPONSE CURRENT SOURCE

(75) Inventors: Min-Hung Hu, Hsinchu (TW); Chiu-Huang Huang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 271 days.

(21) Appl. No.: 13/470,366

(22) Filed: May 14, 2012

(65) Prior Publication Data

US 2012/0319665 A1 Dec. 20, 2012

(30) Foreign Application Priority Data

Jun. 14, 2011 (TW) ..... 100120725 A

(51) Int. Cl.
*G05F 1/16* (2006.01)
*G05F 1/56* (2006.01)

(52) U.S. Cl.
CPC ..... *G05F 1/561* (2013.01)

(58) Field of Classification Search
CPC ..... G05F 3/22; G05F 3/24; G05F 3/30; G05F 3/242; G05F 3/245; G05F 3/247; G05F 3/262; G05F 3/265; G05F 3/267; G05F 1/561; G11C 5/147
USPC ..... 323/312–315; 327/379, 170, 539, 172
See application file for complete search history.

(56) References Cited

U.S. PATENT DOCUMENTS 5,086,238 A * 2/1992 Watanabe et al. ..... 327/539
5,656,969 A * 8/1997 Pulvirenti et al. ..... 327/561
5,877,647 A * 3/1999 Vajapey et al. ..... 327/391
7,075,360 B1 * 7/2006 Holloway et al. ..... 327/543
7,427,854 B2 * 9/2008 Redoute et al. ..... 323/316
7,595,622 B1 9/2009 Tomiyoshi et al.
8,614,595 B2 * 12/2013 Acatrinei ..... 327/172
(Continued)

FOREIGN PATENT DOCUMENTS

| | | |
|---|---|---|
| CN | 1740937 A | 3/2006 |
| EP | 720728 | 6/2002 |
| TW | 565761 | 12/2003 |
| TW | 200715089 | 4/2007 |
| TW | M368010 | 11/2009 |
| TW | I322935 | 4/2010 |
| TW | 201111938 | 4/2011 |

OTHER PUBLICATIONS

Ka Nang Leung, et al, "Development of Energy-Efficient Fast-Transient CMOS Low-Dropout Regulators for SoC Applications," Circuits and Systems, Mar. 18, 2011, pp. 1-4.
"First Office Action of China Counterpart Application", issued on Jan. 30, 2014, p. 1-p. 12, in which the listed references were cited.
"Office Action of Taiwan counterpart application" issued on Dec. 5, 2013, p. 1-p. 5, in which the listed references were cited.

*Primary Examiner* — Gary L Laxton
*Assistant Examiner* — Kevin H Sprenger
(74) *Attorney, Agent, or Firm* — Jianq Chyun IP Office

(57) ABSTRACT

A fast response current source capable of providing an output current is disclosed. The fast response current source includes a constant current generating block, a first feedback capacitor, a first current buffer and a first output current generating block. The constant current generating block provides a first constant current. The first current buffer generates a first buffering current to flow through the first feedback terminal, and changes a current value of the first buffering current in response to the current variation at the first feedback terminal when the voltage at the output terminal is varied. The first output current generating block generates a first output current to flow through the output terminal, and changes a current value of the first output current in response to the variation of the first buffering current when the voltage at the output terminal is varied.

30 Claims, 3 Drawing Sheets

(56) References Cited

U.S. PATENT DOCUMENTS

2004/0164789 A1 8/2004 Leung et al.
2004/0183715 A1 9/2004 Arlow
2004/0207452 A1* 10/2004 Vorenkamp ..... 327/379
2005/0088153 A1 4/2005 Suzuki
2005/0200392 A1* 9/2005 Cho et al. ..... 327/170
2006/0192538 A1 8/2006 Wang et al.
2008/0123706 A1 5/2008 Zak et al.
2009/0058323 A1 3/2009 Yang

* cited by examiner

FAST RESPONSE CURRENT SOURCE

CROSS-REFERENCE TO RELATED APPLICATION

This application claims the priority benefit of Taiwan application serial no. 100120725, filed on Jun. 14, 2011. The entirety of the above-mentioned patent application is hereby incorporated by reference herein and made a part of this specification.

BACKGROUND OF THE INVENTION

1. Field of the Invention

The invention relates to a fast response current source. Particularly, the invention relates to a fast response current source capable of dynamically adjusting an output current according to a load demand.

2. Description of Related Art

In a conventional voltage regulator, a feedback circuit is generally used to lock an output voltage to be generated, and a regulation capacitor is disposed at an output terminal of the voltage regulator to assist voltage regulation capability of the voltage regulator. Configuration of the regulation capacitor is mainly to convert pre-stored charges into a driving current for providing to a load when a demand current of the load driven by the voltage regulator is sharply varied, so as to maintain stability of the voltage output from the output terminal of the voltage regulator. In other words, to ensure that the voltage regulator endures a large variation of the demand current of the load, the regulation capacitor of a large size has to be used. Configuration of the large size regulation capacitor increases the cost of the voltage regulator and decreases a response speed of the voltage regulator.

Certainly, in the conventional voltage regulator, a design without using the regulation capacitor is also provided, and such type of the voltage regulator requires a complicated detecting circuit to detect a dynamic variation of the demand current of the load through the output terminal of the voltage regulator, and dynamically adjust the driving current generated by the voltage regulator according to the detected dynamic variation of the demand current of the load. Since such voltage regulator requires the complicated current detecting circuit, the circuit cost is increased and additional current consumption of the current detecting circuit is required.

SUMMARY OF THE INVENTION

The disclosure is directed to a fast response current source, which is capable of quickly adjusting a produced output current according to a variation of a demand current of a load.

In one aspect, a fast response current source is provided, including a constant current generating block, a first feedback capacitor, a first current buffer and a first output current generating block. The constant current generating block is coupled to a first feedback terminal for providing a first constant current to flow through the first feedback terminal. The first feedback capacitor is coupled between an output terminal and the first feedback terminal for coupling a voltage variation of the output terminal to the first feedback terminal when a voltage of the output terminal has a rising variation or a falling variation. The first current buffer is coupled to the first feedback terminal for generating a first buffering current to flow through the first feedback terminal, and changing a current value of the first buffering current in response to a corresponding current variation of the first feedback terminal when the voltage at the output terminal has the above variation. The first output current generating block is coupled to the first current buffer for generating a first output current to flow through the output terminal, and changing a current value of the first output current in response to a corresponding variation of the first buffering current when the voltage at the output terminal has the above variation.

According to the above descriptions, the current buffer is used to change the current value of the first buffering current in response to a corresponding current variation of the first feedback terminal when the voltage at the output terminal is varied. Moreover, the first output current generating block is used to quickly adjust the current value of the first output current in response to the current variation of the first buffering current. In this way, when a demand current of the load of the fast response current source is suddenly increased, a sufficient amount of driving current can be provided to satisfy the load demand, and when the demand current of the load is recovered to normal, the increased driving current can be quickly decreased to avoid an overshoot phenomenon of the load.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
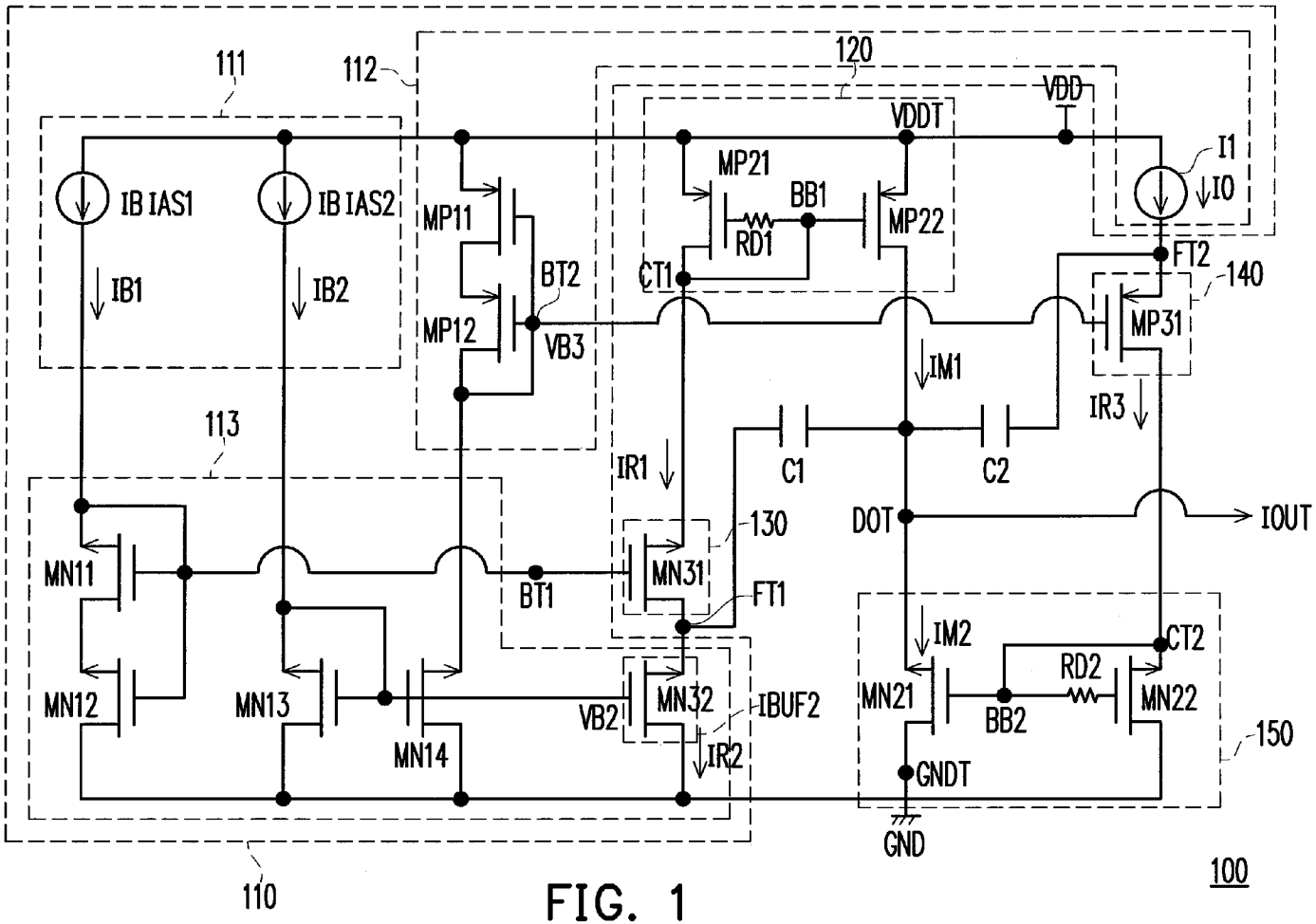
FIG. 1 is a circuit diagram of a fast response current source 100 according to an embodiment of the invention.

Referring to FIG. 1, FIG. 1 is a circuit diagram of a fast response current source 100 according to an embodiment of the invention. The fast response current source 100 is used for providing a load current IOUT to a load. In the present embodiment, the fast response current source 100 can provide stable and tiny stable component of the load current IOUT, and can quickly respond to a current demand of the connected load to provide a fast and large transient component of the load current IOUT.

The fast response current source 100 includes a constant current generating block 110, which is used for providing stable voltages and currents required in operations of the other devices. Moreover, the fast response current source 100 further includes a feedback capacitor C1, a current buffer 130 and an output current generating block 120. In collaboration with the tripartite operations, when a voltage of an output terminal DOT is decreased as the load is dramatically increased, the load current IOUT can be quickly increased.

The constant current generating block 110 is coupled to a feedback terminal FT1 for providing a constant current IR2 to flow through the feedback terminal FT1.

The feedback capacitor C1 is coupled between the output terminal DOT and the feedback terminal FT1. When the voltage of the output terminal DOT has a falling variation, a transient current immediately flows through the feedback capacitor C1 to the output terminal DOT, and a current of the feedback terminal FT1 is transiently increased. In other words, when the voltage of the output terminal DOT has the falling variation, the feedback capacitor C1 couples a voltage variation of the output terminal DOT to the feedback terminal FT1.

The current buffer 130 is coupled to the feedback terminal FT1 and is used for generating a buffering current IR1 to flow through the feedback terminal FT1. When the voltage at the output terminal DOT has the falling variation, in response to a current increase of the feedback terminal FT1, a current value of the buffering current IR1 generated by the current buffer 130 is also increased.

On the other hand, the output current generating block 120 is coupled to the current buffer 130 through a coupling terminal CT1, and generates an output current IM1 according to a voltage of the coupling terminal CT1. When the buffering current IR1 at the feedback terminal FT1 is increased, the voltage level of the coupling terminal CT1 is decreased. Therefore, when the voltage of the output terminal DOT has the falling variation, the output current generating block 120 generates the relatively large output current IM1 in response to the increase of the buffering current IR1. As a result, the load current IOUT can be quickly increased.

According to the above descriptions, when the voltage of the output terminal DOT has the falling variation, a transient current is generated to flow through the feedback capacitor C1. Based on the current buffer 130, the buffering current IR1 flowing through the feedback terminal FT1 is quickly increased, and meanwhile the voltage level at the coupling terminal CT1 is correspondingly decreased. Finally, the current value of the output current IM1 can be quickly increased through the output current generating block 120, so as to further increase the current value of the load current IOUT.

Moreover, the fast response current source 100 can also include a feedback capacitor C2, a current buffer 140 and an output current generating block 150. In collaboration with the tripartite operations, when the voltage of the output terminal DOT is increased as the load is dramatically decreased, the load current IOUT can be quickly decreased.

The feedback capacitor C2 is coupled between the output terminal DOT and a feedback terminal FT2 for coupling a voltage variation of the output terminal DOT to the feedback terminal FT2 when the voltage of the output terminal DOT has a rising variation.

The current buffer 140 is coupled to the feedback terminal FT2, and is used for generating a buffering current IR3 to flow through the feedback terminal FT2. When the voltage at the output terminal DOT has the rising variation, in response to a current increase of the feedback terminal FT2, a current value of the buffering current IR3 generated by the current buffer 140 is also increased.

The output current generating block 150 is coupled to the current buffer 140 through a coupling terminal CT2, and generates an output current IM2 according to a voltage of the coupling terminal CT2. When the buffering current IR3 at the feedback terminal FT2 is increased, the voltage level of the coupling terminal CT2 is accordingly increased. Therefore, when the voltage of the output terminal DOT has the rising variation, the output current generating block 150 generates the relatively large output current IM2 in response to the increase of the buffering current IR3. As a result, the load current IOUT can be quickly decreased.

According to the above descriptions, when the voltage of the output terminal DOT has the rising variation, a transient current is generated to flow through the feedback capacitor C2. Based on the current buffer 140, the buffering current IR3 flowing through the feedback terminal FT2 is quickly increased, and meanwhile the voltage level at the coupling terminal CT2 is correspondingly increased. Finally, the current value of the output current IM2 can be quickly increased through the output current generating block 150, so as to further decrease the current value of the load current IOUT.

An unique feature of the embodiment is that the current buffer 130 is used to sense the current variation of the feedback terminal FT1, and the current buffer 140 is used to sense the current variation of the feedback terminal FT2. A main reason for using the current buffers 130 and 140 to sense the current variations of the feedback terminals FT1 and FT2 is that the current buffer has features of low input impedance, high output impedance and high gain. Therefore, once the voltage at the output terminal DOT is varied, the buffering current IR1 output by the current buffer 130 or the buffering current IR3 output by the current buffer 140 can quickly change with a sufficiently large variation magnitude. Accordingly, the output current IM1 of the output current generating block 120 or the output current IM2 of the output current generating block 150 can quickly change. As a result, the load current IOUT can be quickly changed along with a variation of the load.

It should be noticed that in the fast response current source 100, the feedback capacitor C1, the current buffer 130 and the output current generating block 120 are used to deal with a dramatic increase of the load, and the feedback capacitor C2, the current buffer 140 and the output current generating block 150 are used to deal with a dramatic decrease of the load. However, the invention is not limited thereto, and according to a design requirement, a part of the circuits can be used in collaboration with other output circuit to generate the load current.

Various embodiments are provided below to describe detail structures and operations of various components of the fast response current source 100.

FIG. 1 also illustrates an exemplary embodiment of a detailed structure of the current buffer 130. In the present embodiment, the current buffer 130 is simply constructed by a transistor MN31, though the invention is not limited thereto. A control terminal (a gate) of the transistor MN31 is coupled to the constant current generating block 110 for receiving a voltage VB1 at a regulation terminal BT1 of the constant current generating block 110. Moreover, a source/drain of the transistor MN31 is coupled to the feedback terminal FT1, and the drain/source thereof is coupled to the output current generating block 120. Under such coupling structure, the buffering current IR1 generated by the transistor MN31 is determined according to the voltage VB1 and the voltage at the feedback terminal FT1. Since the voltage VB1 at the regulation terminal BT1 is in a stable state, the buffering current IR1 is changed in response to a variation of the voltage at the feedback terminal FT1. Therefore, once the voltage at the output terminal DOT is decreased to decrease the voltage at the feedback terminal FT1, the buffering current IR1 output by the transistor MN31 is correspondingly increased.

FIG. 1 also illustrates an exemplary embodiment of a detailed structure of the current buffer 140. Similar to the buffer device 130, the current buffer 130 is simply constructed by a transistor MP31, though the invention is not limited thereto. A gate of the transistor MP31 is coupled to a regulation terminal BT2 in the constant current generating block 110 for receiving a voltage VB3 at the regulation terminal BT2. A source/drain of the transistor MP31 is coupled to the feedback terminal FT2, and the drain/source thereof is coupled to the coupling terminal CT2 in the output current generating block 150. In this way, the current buffer 140 can generate the buffering current IR3 according to the voltage VB3 and the voltage at the feedback terminal FT2. As a result, once the voltage at the output terminal DOT is increased to increase the voltage at the feedback terminal FT2, the buffering current IR3 output by the transistor MP31 is correspondingly increased.

FIG. 1 also illustrates an embodiment of a detailed structure of the output current generating block 120. The output current generating block 120 is preferably implemented by a bias current source, though the invention is not limited thereto. The bias current source is designed to generate the output current IM1 according to a voltage at a bias terminal BB1, where the voltage at the bias terminal BB1 is determined according to the voltage of the coupling terminal CT1.

The bias current source generally includes a bias device and a current output device. Preferably, the bias device is coupled to the current output device through the bias terminal BB1, and is coupled to the current buffer 130 through the coupling terminal CT1. The bias device is used for feeding back the voltage at the coupling terminal CT1 to generate a bias voltage at the bias terminal BB1 for providing to an output transistor MP22. Then, the current output device generates the output current IM1 to flow through the output terminal DOT according to the bias voltage at the bias terminal BB1.

In detail, the bias device is, for example, composed of a bias transistor MP21, and the current output device is composed of the output transistor MP22, though the invention is not limited thereto. A gate of the output transistor MP22 is coupled to the bias terminal BB1, the source/drain thereof is coupled to a voltage source terminal VDDT for receiving a voltage source VDD, and the drain/source thereof is coupled to the output terminal DOT. Moreover, a gate of the bias transistor MP21 is coupled to the bias terminal BB1, a source/drain thereof is coupled to the voltage source terminal VDDT, and the drain/source thereof is coupled to the coupling terminal CT1. Under such configuration, once the voltage at the output terminal DOT is decreased to decrease the voltage level of the coupling terminal CT1, the output current generating block 120 can generate the relatively large output current IM1.

It should be noticed that a resistor device RD1 can be coupled in series on a coupling path of the transistor MP21 and the bias terminal BB1. The resistor device RD1 can prevent an instant change of a voltage at the gate of the bias transistor MP21 along with a variation of the voltage at the coupling terminal CT1 to cause that the bias transistor MP21 increases the generated current to charge the gate of the transistor MP22 to suppress the capability that the transistor MP22 provides the output current IM1.

Moreover, FIG. 1 also illustrates an embodiment of a detailed structure of the output current generating block 150. In the embodiment, similar to the output current generating block 120, the output current generating block 150 includes a bias current source composed of a bias transistor MN22 and an output transistor MN21.

The bias transistor MN22 is used for constructing a bias device in the bias current source. A gate of the bias transistor MN22 is coupled to a bias terminal BB2, a source/drain thereof is coupled to a voltage source terminal GNDT for receiving a voltage source GND, and the drain/source thereof is coupled to the coupling terminal CT2. The bias terminal BB2 is further coupled to the coupling terminal CT2. The transistor MN21 is an output transistor, and a gate thereof is coupled to the bias terminal BB2, a source/drain thereof is coupled to the voltage source terminal GNDT, and the drain/source thereof is coupled to the output terminal DOT. Under such configuration, once the voltage at the output terminal DOT is increased to increase the voltage level of the coupling terminal CT2, the output current generating block 150 can generate the relatively large output current IM2.

Moreover, a resistor device RD2 is coupled in series on a coupling path of the bias transistor MN22 and the bias terminal BB2. The resistor device RD2 can prevent an instant change of a voltage at the gate of the bias transistor MN22 along with a variation of the voltage at the coupling terminal CT2 causing the bias transistor MN22 to increase the generated current to charge the gate of the output transistor MN21 and thereby suppress the capability of providing the output current IM2 by the output transistor MN21.

On the other hand, FIG. 1 also illustrates an embodiment of a detailed structure of the constant current generating block 110. In the embodiment, the constant current generating block 110 includes a reference current source 111, a current mirror 113 formed by transistors MN11, MN13 and MN32, and a current source I1. The reference current source 111 respectively generates reference currents IB1 and IB2. The current mirror 113 formed by the transistors MN11, MN13 and MN32 is coupled to the reference current source 111 and the feedback terminal FT1. The transistors MN11 and MN13 respectively receive the reference currents IB1 and IB2, and the transistor MN32 mirrors the reference current IB2 received by the transistor MN13 to generate the constant current IR2, where the constant current IR2 flows through the feedback terminal FT1.

The reference current source 111 may include current sources IBIAS1 and IBIAS2, where the current source IBIAS1 generates the reference current IB1 and provides the reference current IB1 to the transistors MN11 and MN12, and the current source IBIAS2 generates the reference current IB2 and provides the reference current IB2 to the transistor MN13.

Moreover, the constant current generating block 110 is further coupled to a feedback terminal FT2, and provides a constant current I0 to flow through the feedback terminal FT2. The constant current I0 is, for example, provided by a current mirror 112 constructed by the current source I1 and transistors MP11 and MP12.

Figure 2:
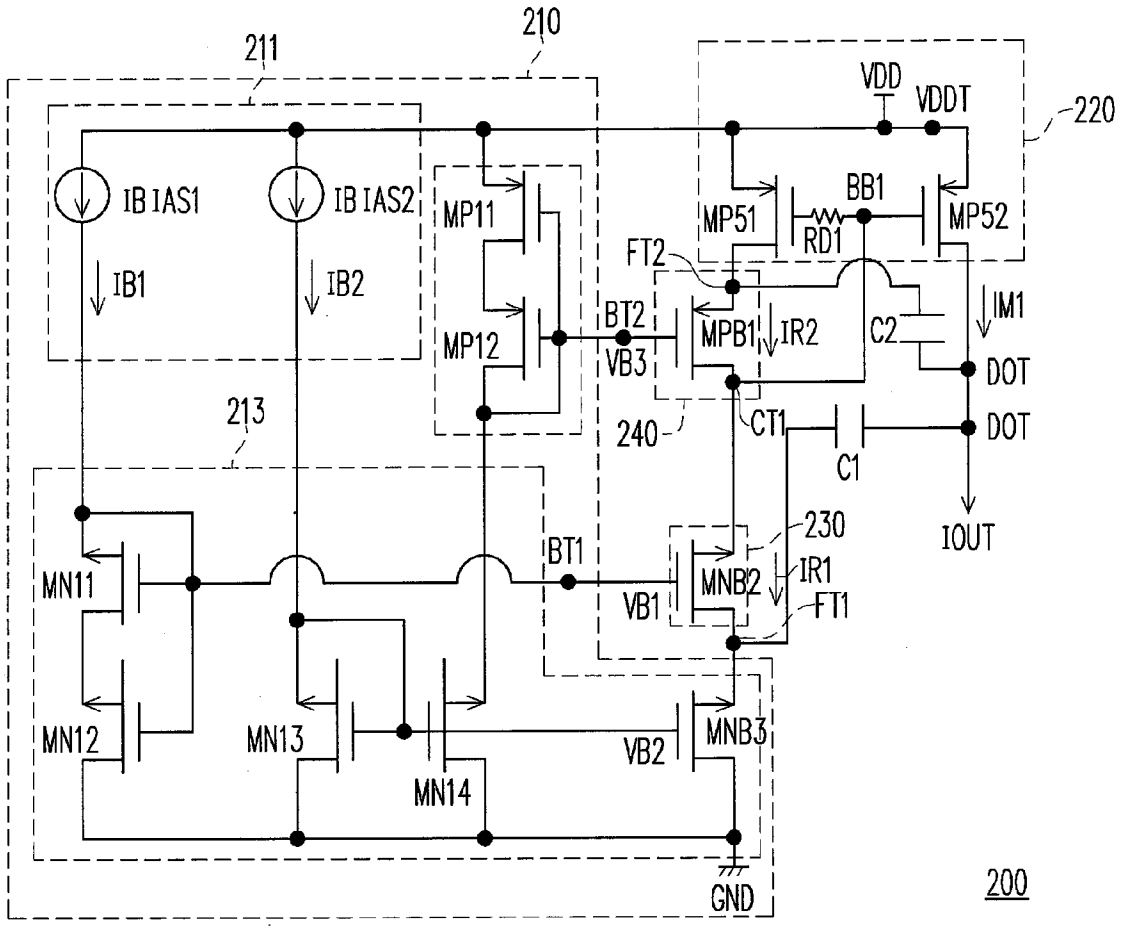
FIG. 2 is a circuit diagram of a fast response current source 200 according to another embodiment of the invention.

FIG. 2 is a circuit diagram of a fast response current source 200 according to another embodiment of the invention. The fast response current source 200 includes a constant current generating block 210, feedback capacitors C1 and C2, current buffers 230 and 240, and an output current generating block 220. A main difference between the fast response current source 200 and the fast response current source 100 of FIG. 1 is that the current buffers 230 and 240 are coupled in series, and control the same current generating block 220 to generate the output current IM1.

The constant current generating block 210 includes a reference current source 211 and a current mirror 213 formed by transistors MN11, MN12, MN13, MN14 and MNB3. An operation method of the constant current generating block 210 is similar as that described in the aforementioned embodiment, which is not repeated herein for simplicity's sake.

Similar to the fast response current source 100, in collaboration with the operations of the feedback capacitor C1, the current buffer 230 and the output current generating block 220, when the voltage of the output terminal DOT is decreased as the load is dramatically increased, the load current IOUT is quickly increased.

In detail, the feedback capacitor C1 is coupled between the output terminal DOT and the feedback terminal FT1, and when the voltage at the output terminal DOT has the falling variation, the voltage variation of the output terminal DOT can be coupled to the feedback terminal FT1 through the feedback capacitor C1. The current buffer 230 is coupled between the coupling terminal CT1 and the feedback terminal FT1. The current buffer 230 is used to generate the buffering current IR1, and changes a current value of the buffering current IR1 in response to the corresponding current variation of the feedback terminal FT1 when the voltage at the output terminal DOT has the falling variation. Moreover, the output current generating block 220 is further coupled to the current buffer 230 through the current buffer 240, and changes a current value of the output current IM1 in response to a corresponding variation of the buffering current IR1 when the voltage at the output terminal DOT is varied.

On the other hand, in collaboration with the operations of the feedback capacitor C2, the current buffer 240 and the output current generating block 220, when the voltage of the output terminal DOT is increased as the load is dramatically decreased, the load current IOUT is quickly decreased.

In detail, the feedback capacitor C2 is coupled between the output terminal DOT and the feedback terminal FT2, and when the voltage at the output terminal DOT has the rising variation, the voltage variation of the output terminal DOT can be coupled to the feedback terminal FT2 through the feedback capacitor C2.

The current buffer 240 is coupled between the feedback terminal FT2 and the current buffer 230. The current buffer 240 is used to generate the buffering current IR2 to flow through the feedback terminal FT2, and changes a current value of the buffering current IR2 in response to the corresponding current variation of the feedback terminal FT2 when the voltage at the output terminal DOT has the rising variation. Moreover, the output current generating block 220 is further coupled to the current buffer 240, and changes a current value of the output current IM1 in response to a corresponding variation of the buffering current IR2 when the voltage at the output terminal DOT is varied.

FIG. 2 also illustrates an exemplary embodiment of detailed structures of the current buffers 230 and 240.

In the present embodiment, the current buffers 230 and 240 are respectively constructed by buffer transistors MNB1 and MPB1, though the invention is not limited thereto. A gate of the buffer transistor MNB2 is coupled to the regulation terminal BT1 in the constant current generating block 210, a source/drain thereof is coupled to the feedback terminal FT1, and the drain/source thereof is coupled to the output current generating block 220. Under such a configuration, once the voltage at the output terminal DOT is decreased to decrease the voltage at the feedback terminal FT1, the buffering current IR1 output by the transistor MNB2 is correspondingly increased. A gate of the buffer transistor MPB1 is coupled to the regulation terminal BT2 in the constant current generating block 210, a source/drain thereof is coupled to the feedback terminal FT2, and the drain/source thereof is coupled to the output current generating block 220. Under such configuration, once the voltage at the output terminal DOT is increased to increase the voltage at the feedback terminal FT2, the buffering current IR2 output by the transistor MPB2 is correspondingly increased.

FIG. 2 also illustrates an exemplary embodiment of a detailed structure of the output current generating block 220. In the embodiment, the output current generating block 220 includes a bias current source composed of a current output device constructed by an output transistor MP52 and a bias device constructed by a bias transistor MP51, though the invention is not limited thereto. The current output device constructed by the MP52 is used to generate the output current IM1 according to a voltage at the bias terminal BB1, where the output current IM flows through the output terminal DOT. The bias device constructed by the bias transistor MP51 is used to feed back the voltage at the coupling terminal CT1 to bias the bias terminal BB1. A gate of the output transistor MP52 is coupled to the bias terminal BB1, a source/drain thereof is coupled to the voltage source terminal VDDT for receiving the voltage source VDD, and the drain/source thereof is coupled to the output terminal DOT. A gate of the bias transistor MP51 is coupled to the bias terminal BB1, a source/drain thereof is coupled to the voltage source terminal VDDT for receiving the voltage source VDD, and the drain/source thereof is coupled to the coupling terminal CT1. The bias terminal BB1 is coupled to the coupling terminal CT1.

Moreover, a resistor device RD1 is coupled in series between the current output device and the bias device. In detail, the resistor device RD1 is coupled in series between the gate of the bias transistor MP51 and the bias terminal BB1. The resistor device RD1 can prevent a change of a voltage at the gate of the bias transistor MP51 to cause the bias transistor MP51 to increase the generated current to charge the gate of the output transistor MP52 and thereby suppress the capability of providing the output current IM1 by the transistor MP52.

Figure 3:
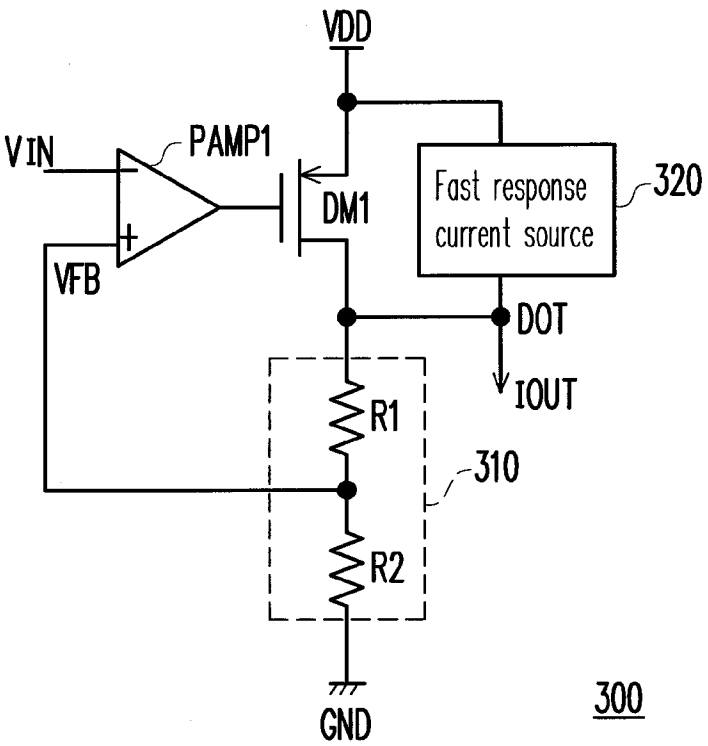
FIG. 3 is a circuit diagram of a voltage regulator 300 according to another embodiment of the invention.

Referring to FIG. 3, FIG. 3 is a circuit diagram of a voltage regulator 300 according to another embodiment of the invention. The voltage regulator 300 includes an operational amplifier OPAMP1, a driving transistor DM1 and a fast response current source 320. An input terminal of the operational amplifier OPAMP1 receives an input voltage VIN, and another input terminal thereof receives a feedback voltage VFB. Moreover, the input voltage VIN can be provided by a so-called band gap voltage generating circuit. In this way, the output voltage generated by the voltage regulator 300 is more stable (non-related to variation of an environmental temperature).

A control terminal (a gate) of the driving transistor DM1 is coupled to an output terminal of the operational amplifier OPAMP1, and one terminal of the driving transistor DM1 is coupled to a power voltage VDD, and another terminal thereof is coupled to a voltage dividing circuit 310.

The voltage dividing circuit 310 is coupled between a driving output terminal DOT of the voltage regulator 300 and the operational amplifier OPAMP1. The voltage dividing circuit 310 is used to divide a voltage at the driving output terminal DOT to generate the feedback voltage VFB.

The voltage dividing circuit 310 may include resistors R1 and R2 coupled in series, and is used to divide the voltage at the driving output terminal DOT to generate the feedback voltage VFB.

It should be noticed that the fast response current source 320 is coupled across two terminals (the terminal coupled to the voltage source VDD and the terminal coupled to the voltage dividing circuit 310) of the driving transistor DM1. The fast response current source 320 can be implemented by one of the fast response current sources 100 and 200 of the invention to produce the load current IOUT required to be generated by the voltage regulator 300. Operation details of the fast response current sources 100 and 200 have been described in detail in the embodiments of FIG. 1 and FIG. 2, and detailed descriptions thereof are not repeated.

In summary, by constructing the feedback capacitor at the output terminal of the fast response current source, the voltage variation of the load at the output terminal caused by the current demand variation can be fed back, and the current buffer performs a charging or discharging operation corresponding to an instantaneous increase or decrease of the demand current of the load. In this way, the fast response current source can dynamically increase or suppress the output current according to the current demand of the load, so as to quickly and stably satisfy the demand of the load.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A fast response current source, comprising:

a constant current generating block, coupled to a first feedback terminal, for providing a first constant current to flow through the first feedback terminal;

a first feedback capacitor, coupled between an output terminal and the first feedback terminal, for coupling a voltage variation of the output terminal to the first feedback terminal when a voltage of the output terminal has one of a rising variation and a falling variation;

a first current buffer, coupled to the first feedback terminal, for generating a first buffering current to flow through the first feedback terminal, and changing a current value of the first buffering current in response to a corresponding current variation of the first feedback terminal when the voltage at the output terminal has the falling variation; and a first output current generating block, coupled to the first current buffer, for generating a first output current to flow through the output terminal, and changing a current value of the first output current in response to a corresponding variation of the first buffering current, wherein when the voltage at the output terminal has the falling variation, the first buffering current is increased, and the first output current is increased according to the increasing of the first buffering current.

2. The fast response current source as claimed in claim 1, wherein the first current buffer is further coupled to a first regulation terminal in the constant current generating block for generating the first buffering current according to a voltage at the first regulation terminal and a voltage at the first feedback terminal.

3. The fast response current source as claimed in claim 1, wherein the first current buffer comprises:

a first buffer transistor, having a gate coupled to a first regulation terminal in the constant current generating block, a first source/drain coupled to the first feedback terminal, and a second source/drain coupled to the first output current generating block.

4. The fast response current source as claimed in claim 1, wherein the first current buffer is coupled to the first output current generating block at a first coupling terminal, and changes a voltage level of the first coupling terminal in response to a corresponding current variation of the first feedback terminal when the voltage at the output terminal has the variation.

5. The fast response current source as claimed in claim 4, wherein the first output current generating block comprises a first bias current source for generating the first output current according to a voltage of a first bias terminal, wherein the voltage of the first bias terminal is determined according to a voltage of the first coupling terminal.

6. The fast response current source as claimed in claim 1, wherein the first output current generating block comprises a first bias current source, and the first bias current source comprises:

a first current output device, coupled to a first bias terminal and the output terminal, for generating the output current to flow through the output terminal according to a voltage of the first bias terminal; and a first bias device, coupled to the first current output device through the first bias terminal, and coupled to the first current buffer through a first coupling terminal, and feeding back a voltage of the first coupling terminal to bias the first bias terminal.

7. The fast response current source as claimed in claim 6, wherein the first current output device comprises a first output transistor having a gate coupled to the first bias terminal, a first source/drain coupled to a first voltage source terminal, and a second source/drain coupled to the output terminal.

8. The fast response current source as claimed in claim 6, wherein the first bias device comprises a first bias transistor having a gate coupled to the first bias terminal, a first source/drain coupled to a first voltage source terminal, and a second source/drain coupled to the first coupling terminal, wherein the first bias terminal is further connected to the first coupling terminal.

9. The fast response current source as claimed in claim 8, wherein the first bias current source further comprises:

a first resistor device, coupled between the gate of the first bias transistor and the first bias terminal.

10. The fast response current source as claimed in claim 1, wherein the constant current generating block comprises:

a reference current source, generating at least one reference current; and a first current mirror, coupled to the reference current source and the first feedback terminal, and generating the first constant current to flow through the first feedback terminal according to the at least one reference current.

11. The fast response current source as claimed in claim 1, wherein the constant current generating block is further coupled to a second feedback terminal for providing a second constant current to flow through the second feedback terminal, and the fast response current source further comprises:

a second feedback capacitor, coupled between the output terminal and the second feedback terminal, for coupling another voltage variation of the output terminal to the second feedback terminal when the voltage of the output terminal has another one of the rising variation and the falling variation;

a second current buffer, coupled to the second feedback terminal, for generating a second buffering current to flow through the second feedback terminal, and changing a current value of the second buffering current in response to a corresponding current variation of the second feedback terminal when the voltage at the output terminal has the rising variation; and a second output current generating block, coupled to the second current buffer, for generating a second output current to flow through the output terminal, and changing a current value of the second output current in response to a corresponding variation of the second buffering current when the voltage at the output terminal has the rising variation.

12. The fast response current source as claimed in claim 11, wherein the first and the second current buffers are respectively coupled to a first and a second regulation terminals in the constant current generating block for respectively generating the first buffering current according to a voltage at the first regulation terminal and a voltage at the first feedback terminal, and generating the second buffering current according to a voltage at the second regulation terminal and a voltage at the second feedback terminal.

13. The fast response current source as claimed in claim 11, wherein the first current buffer comprises:

a first buffer transistor, having a gate coupled to the first regulation terminal in the constant current generating block, a first source/drain coupled to the first feedback terminal, and a second source/drain coupled to the first output current generating block;

the second current buffer comprises:

a second buffer transistor, having a gate coupled to a second regulation terminal in the constant current generating block, a first source/drain coupled to the second feedback terminal, and a second source/drain coupled to the second output current generating block.

14. The fast response current source as claimed in claim 11, wherein the first current buffer is coupled to the first output current generating block at a first coupling terminal, and changes a voltage level of the first coupling terminal in response to a corresponding current variation of the first feedback terminal when the voltage at the output terminal has the falling variation, and the second current buffer is coupled to the second output current generating block at a second coupling terminal, and changes a voltage level of the second coupling terminal in response to a corresponding current variation of the second feedback terminal when the voltage at the output terminal has the rising variation.

15. The fast response current source as claimed in claim 14, wherein the first and the second output current generating blocks respectively comprise a first and a second bias current sources for respectively generating the first and the second output currents according to voltages of the first and the second bias terminals, wherein the voltages of the first and the second bias terminals are respectively determined according to voltages of the first and the second coupling terminals, wherein the second bias terminal is coupled to the second coupling terminal.

16. The fast response current source as claimed in claim 11, wherein the first and the second output current generating blocks respectively comprise a first and a second bias current sources, the first bias current source comprises:

a first current output device, coupled to a first bias terminal and the output terminal, for generating the output current to flow through the output terminal according to a voltage of the first bias terminal; and a first bias device, coupled to the first current output device through the first bias terminal, and coupled to the first current buffer through a first coupling terminal, and feeding back a voltage of the first coupling terminal to bias the first bias terminal, and the second bias current source comprises:

a second current output device, coupled to a second bias terminal and the output terminal, for generating the output current to flow through the output terminal according to a voltage of the second bias terminal; and a second bias device, coupled to the second current output device through the second bias terminal, and coupled to the second current buffer through a second coupling terminal, and feeding back a voltage of the second coupling terminal to bias the second bias terminal.

17. The fast response current source as claimed in claim 16, wherein the first current output device comprises:

a first output transistor, having a gate coupled to the first bias terminal, a first source/drain coupled to a first voltage source terminal, and a second source/drain coupled to the output terminal, the second current output device comprises:

a second output transistor, having a gate coupled to the second bias terminal, a first source/drain coupled to a second voltage source terminal, and a second source/drain coupled to the output terminal.

18. The fast response current source as claimed in claim 16, wherein the first bias device comprises:

a first bias transistor, having a gate coupled to the first bias terminal, a first source/drain coupled to a first voltage source terminal, and a second source/drain coupled to the first coupling terminal, wherein the first bias terminal is further connected to the first coupling terminal; and a second bias transistor, having a gate coupled to the second bias terminal, a first source/drain coupled to a second voltage source terminal, and a second source/drain coupled to the second coupling terminal, wherein the second bias terminal is further connected to the second coupling terminal.

19. The fast response current source as claimed in claim 18, wherein the first and the second bias current sources respectively comprise a first resistor device coupled between the gate of the first bias transistor and the first bias terminal and a second resistor device coupled between the gate of the second bias transistor and the second bias terminal.

20. The fast response current source as claimed in claim 11, wherein the constant current generating block comprises:

a reference current source, generating at least one reference current; and a first current mirror, coupled to the reference current source and the first feedback terminal, and generating the first constant current to flow through the first feedback terminal according to the at least one reference current; and a second current mirror, coupled to the reference current source and the second feedback terminal, and generating the second constant current to flow through the second feedback terminal according to the at least one reference current.

21. The fast response current source as claimed in claim 14, further comprising:

a second feedback capacitor, coupled between the output terminal and the second feedback terminal, for coupling another voltage variation of the output terminal to the second feedback terminal when the voltage of the output terminal has another one of the rising variation and the falling variation;

a second current buffer, coupled between the second feedback terminal and the first current buffer, for generating a second buffering current to flow through the second feedback terminal, and changing a current value of the second buffering current in response to a corresponding current variation of the second feedback terminal when the voltage at the output terminal has the rising variation, wherein the first output current generating block is further coupled to the second current buffer for changing a current value of the first output current in response to a corresponding variation of the second buffering current when the voltage at the output terminal has the rising variation.

22. The fast response current source as claimed in claim 21, wherein the first and the second current buffers are respectively coupled to a first and a second regulation terminals in the constant current generating block for respectively generating the first buffering current according to a voltage at the first regulation terminal and a voltage at the first feedback terminal, and generating the second buffering current according to a voltage at the second regulation terminal and a voltage at the second feedback terminal.

23. The fast response current source as claimed in claim 21, wherein the first current buffer comprises:

a first buffer transistor, having a gate coupled to a first regulation terminal in the constant current generating block, a first source/drain coupled to the first feedback terminal, and a second source/drain coupled to the first output current generating block;

the second current buffer comprises:

a second buffer transistor, having a gate coupled to a second regulation terminal in the constant current generating block, a first source/drain coupled to the second feedback terminal, and a second source/drain coupled to the first output current generating block.

24. The fast response current source as claimed in claim 21, wherein the first and the second current buffers are all coupled to the first output current generating block at a first coupling terminal, and respectively change a voltage level of the first bias terminal in response to corresponding current variations of the first and the second feedback terminals when the voltage at the output terminal has the falling variation or the rising variation.

25. The fast response current source as claimed in claim 24, wherein the first output current generating block comprises a first bias current source for generating the first output current according to a voltage of a first bias terminal, wherein the voltage of the first bias terminal is determined according to voltages of the first and the second coupling terminals.

26. The fast response current source as claimed in claim 21, wherein the first output current generating block comprises a first bias current source, and the first bias current source comprises:

a first current output device, coupled to a first bias terminal and the output terminal, for generating the output current to flow through the output terminal according to a voltage of the first bias terminal; and a first bias device, coupled to the first current output device through the first bias terminal, and coupled to the first and the second current buffers through a first coupling terminal, and feeding back a voltage of the first coupling terminal to bias the first bias terminal.

27. The fast response current source as claimed in claim 26, wherein the first current output device comprises a first output transistor having a gate coupled to the first bias terminal, a first source/drain coupled to a first voltage source terminal, and a second source/drain coupled to the output terminal.

28. The fast response current source as claimed in claim 26, wherein the first bias device comprises a first bias transistor having a gate coupled to the first bias terminal, a first source/drain coupled to a first voltage source terminal, and a second source/drain coupled to the first coupling terminal, wherein the first bias terminal is further connected to the first coupling terminal.

29. The fast response current source as claimed in claim 28, wherein the first bias current source further comprises:

a first resistor device, coupled between the gate of the first bias transistor and the first bias terminal.

30. The fast response current source as claimed in claim 21, wherein the constant current generating block comprises:

a reference current source, generating at least one reference current; and a first current mirror, coupled to the reference current source and the first feedback terminal, and generating the first constant current to flow through the first feedback terminal according to the at least one reference current.

* * * * *